US007066756B2

(12) United States Patent
Lange et al.

(10) Patent No.: US 7,066,756 B2
(45) Date of Patent: Jun. 27, 2006

(54) APPARATUS FOR CONTACTING A CONDUCTIVE SURFACE BY MEANS OF A PIN CONNECTOR

(75) Inventors: Manfred Lange, Riedstadt (DE); Bernhard Delarue, Bensheim (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 10/981,495

(22) Filed: Nov. 5, 2004

(65) Prior Publication Data

US 2005/0118854 A1 Jun. 2, 2005

(30) Foreign Application Priority Data

Nov. 27, 2003 (DE) ..... 103 55 456

(51) Int. Cl.
*H01R 13/62* (2006.01)

(52) U.S. Cl. ..... 439/329; 439/289; 439/953; 439/570

(58) Field of Classification Search ..... 439/329, 439/492, 493–495, 499, 67, 567, 569, 570, 439/353, 357, 953, 289, 571, 607
See application file for complete search history.

(56) References Cited

U.S. PATENT DOCUMENTS

| | | | | |
|---|---|---|---|---|
| 3,436,715 | A * | 4/1969 | Matthews | 439/77 |
| 4,060,295 | A * | 11/1977 | Tomkiewicz | 439/55 |
| 4,087,146 | A * | 5/1978 | Hudson, Jr. | 439/67 |
| 4,602,317 | A * | 7/1986 | Rovnyak et al. | 361/785 |
| 4,768,971 | A * | 9/1988 | Simpson | 439/329 |
| 4,770,645 | A * | 9/1988 | Antes | 439/329 |
| 4,871,315 | A * | 10/1989 | Noschese | 439/67 |
| 4,948,379 | A * | 8/1990 | Evans | 439/329 |
| 4,955,814 | A * | 9/1990 | Christie et al. | 439/77 |
| 5,194,017 | A * | 3/1993 | Consoli | 439/492 |
| 5,199,896 | A * | 4/1993 | Mosquera | 439/329 |
| 5,344,338 | A * | 9/1994 | Colleran et al. | 439/465 |
| 5,462,451 | A * | 10/1995 | Yeh | 439/493 |
| 5,704,807 | A * | 1/1998 | Sherman et al. | 439/570 |
| 5,822,197 | A * | 10/1998 | Thuault | 361/803 |
| 5,842,873 | A * | 12/1998 | Gonzales | 439/63 |
| 5,997,329 | A * | 12/1999 | Kosmala | 439/260 |
| 6,007,359 | A * | 12/1999 | Kosmala | 439/329 |
| 6,371,802 | B1 * | 4/2002 | Smalley et al. | 439/567 |
| 6,454,596 | B1 * | 9/2002 | Montagano et al. | 439/493 |
| 6,579,122 | B1 * | 6/2003 | Chen | 439/570 |
| 6,783,371 | B1 * | 8/2004 | Self et al. | 439/67 |
| 2002/0031931 | A1 | 3/2002 | Yokoyama et al. | |
| 2004/0203274 | A1 * | 10/2004 | Peng | 439/329 |

FOREIGN PATENT DOCUMENTS

| | | | | |
|---|---|---|---|---|
| DE | 10017319 | A1 | 10/2001 | |
| EP | 0 210 686 | A2 * | 2/1987 | 439/570 |
| JP | 05-062742 | A | 3/1993 | |
| JP | 10-302914 | A | 11/1998 | |

* cited by examiner

*Primary Examiner*—Tho D. Ta
(74) *Attorney, Agent, or Firm*—Lawrence E. Laubacher, Sr.; Lawrence E. Laubacher, Jr.

(57) ABSTRACT

A plug connector and printed circuit board assembly and method include a snap-on fastening arrangement wherein a row of resilient contacts on the plug connector are brought into engagement with a corresponding row of strip contacts carried by a planar surface of the printed circuit board, whereupon the plug connector is fastened to the printed circuit board in such a manner as to compress the resilient contacts against the strip contacts.

5 Claims, 2 Drawing Sheets

APPARATUS FOR CONTACTING A CONDUCTIVE SURFACE BY MEANS OF A PIN CONNECTOR

BACKGROUND OF THE INVENTION

1. Field of the Invention

A plug connector and printed circuit board assembly and method include a snap-on fastening arrangement wherein a row of resilient contacts on the plug connector are brought into engagement with a corresponding row of strip contacts carried by a planar surface of the printed circuit board, whereupon the plug connector is fastened to the printed circuit board in such a manner as to compress the resilient contacts against the strip contacts.

2. Description of the Related Art

Various types of arrangements have been proposed in the prior art for connecting multi-contact plug connectors with circuit boards, as evidenced by the U.S. patents to Scheffner U.S. Pat. No. 5,755,822 and Endres, et al., U.S. Pat. No. 6,431,920, among others.

Owing to the pressure of constantly rising costs in the electrical industry and the attendant effort given to simplification and cost reduction for almost all structural elements, there is a need in the art for simple, non-welded means for connecting a multi-contact plug connector with a simple printed circuit board having no pin strip or socket board on the printed circuit board.

According to the present invention, an improved connector arrangement is provided including a printed circuit board having a planar surface provided with contact strips and soldering pads, and a plug connector having corresponding contacts that are made as resilient contacts, and wherein the plug connector can so be fixed to the printed circuit board by means of a snap-on locking arrangement such that the resilient contacts are compressed into contact with the contact strips and soldering pads of the printed circuit board.

As a consequence of the present invention, it is possible to avoid the use of a permanent counterpart on the printed circuit board, such as a pin strip or a solderable socket connector, and to provide a reasonably priced connector that produces positive electrical engagement with the contact strips and soldering pads on the printed circuit board without any actual soldering of the contacts to the soldering pads.

The individual resilient contacts on the plug connector can be fashioned in any desired way. For example, they can each have a contact part, which is supported on the housing of the plug connector via a resilient portion. It is particularly important to make sure that sufficient contact pressure is achieved to produce a vibration-proof contact of the contact parts, in particular, the soldering locations on the printed circuit board.

In this manner, one can reduce the number of boreholes provided in the printed circuit board, since the printed circuit board needs only to be provided with contact pads—for example, soldering pads—on its planar surface. Soldering pins, inserted in the printed circuit board as contacts, on the other hand, are no longer required. Basically, the number of boreholes can thus be reduced to the few necessary boreholes for locking the plug connector on the printed circuit board or for receiving attachment lugs on the printed circuit board.

According to a first embodiment of the invention, the plug connector includes snap-fastener pins that are designed for locking engagement with corresponding fastener apertures contained in the printed circuit board. This embodiment is particularly suitable for use with rather larger plug connectors.

The fastener elements may be connected integrally with the plug connector, or may be made as separate parts for this purpose. The separate design makes it possible for the fastener elements and the remaining plug connector in each case to use the optimum materials with regard to the requirements for the snap-fastening function or for the remainder of the plug connector.

Preferably, the fastener means includes a pair of pins on the plug connector adjacent the ends of the row of resilient contacts, and the printed circuit board merely contains the corresponding attachment holes.

Alternatively, especially for smaller plug connectors, it is also possible to provide along with the row of contact pads, at least one attachment lug that is fastened to the printed circuit board and to which the plug connector is then locked. Preferably, one attachment lug each is provided at each end of the row of contact strips and pads. In this case, the attachment lugs can then in turn include the fastener means for locking the plug connectors to the printed circuit board.

It is also possible to design the attachment lugs as surface-mounted technology attachment lugs. This offers the advantage that only parts with a relatively small mass are used and they, for example, can be set on the printed circuit board at high speed with a multi-spindle turret drill unit. The lugs can be used bilaterally on both ends of the contact pad row so that one needs to make only one type of lugs. The latter furthermore take up less space than the wider pin strips so that the user can use the space for other parts.

Another advantage when using the lugs resides in the fact that only the lugs have to be made of high-grade, high-temperature synthetic plastic material. The plug connectors, on the other hand, can consist of a more favorable plastic because they are not subjected to any heat-producing soldering operation. The wiring of the plug connectors can be handled independently of the attachment of the plug connectors on the printed circuit board also in an independent production step.

Preferably, a twisting protection is afforded for the lugs by the snap-fastener pins (in particular, by using two or more terminal pins).

According to another modification, the lugs, in a supplementary manner, include a sufficiently large suction surface for vacuum pipettes above their center of gravity. In the plug-in state, these pipettes prevent the lugs from being shifted from the soldering clamp. The length of the terminal pins of the little lugs, in particular, is so dimensioned that the reverse side of the printed circuit board can also be printed on with soldering paste. The lugs can thus be delivered ready for the automatic tape-on-reel, tray or tube packages.

It is particularly advantageous when the several attachment lugs produce a coding function and/or a polarization function by means of differing arrangement and/or geometry.

BRIEF SUMMARY OF THE INVENTION

A primary object of the present invention is to provide a plug connector and printed circuit board assembly and method, including a snap-on fastening arrangement for initially effecting electrical engagement between a row of resilient contacts carried by a plug connector and a corresponding row of strip contacts carried by a planar surface of the printed circuit board, and for subsequently simultaneously fastening the plug connector to the printed circuit board and compressing the resilient contacts against the strip contacts.

According to a more specific object of the invention, the plug connector may be provided with a pair of snap-fastener pins that are adapted for engagement with corresponding fastener apertures contained in the printed circuit board. Alternatively, separate fastener lugs may be fastened to the printed circuit board for cooperation with corresponding fastener devices on the plug connector.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1A:
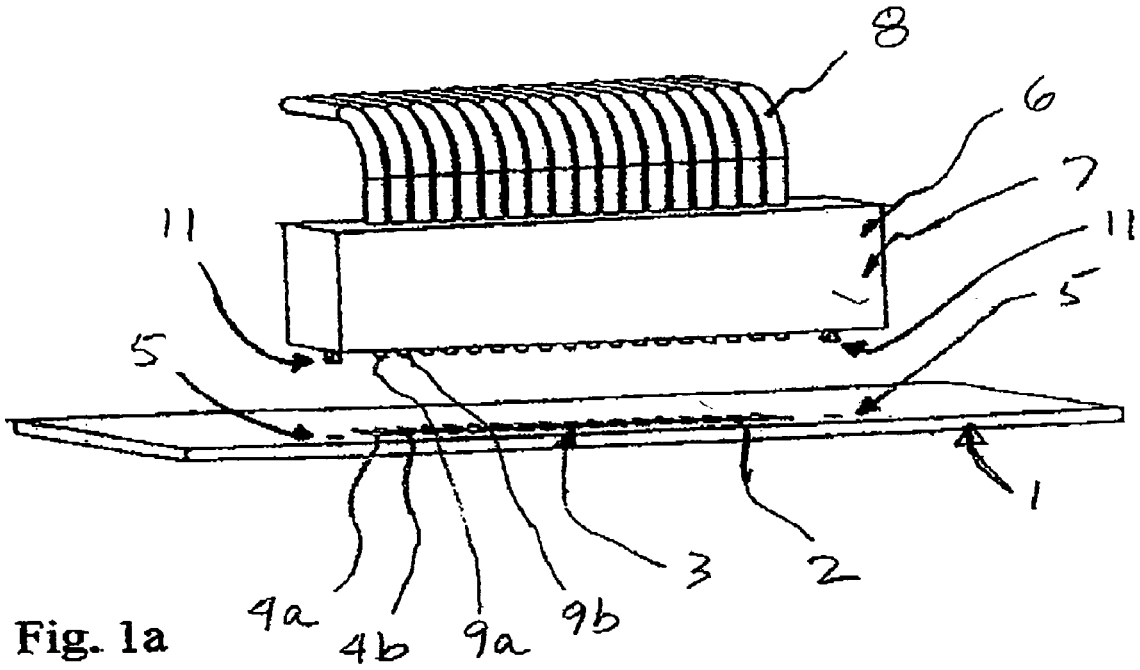
FIGS. 1*a* and 1*b* are front perspective views illustrating the manner of assembly of a first embodiment of the connector plug and printed assembly of the present invention.
Figure 1B:
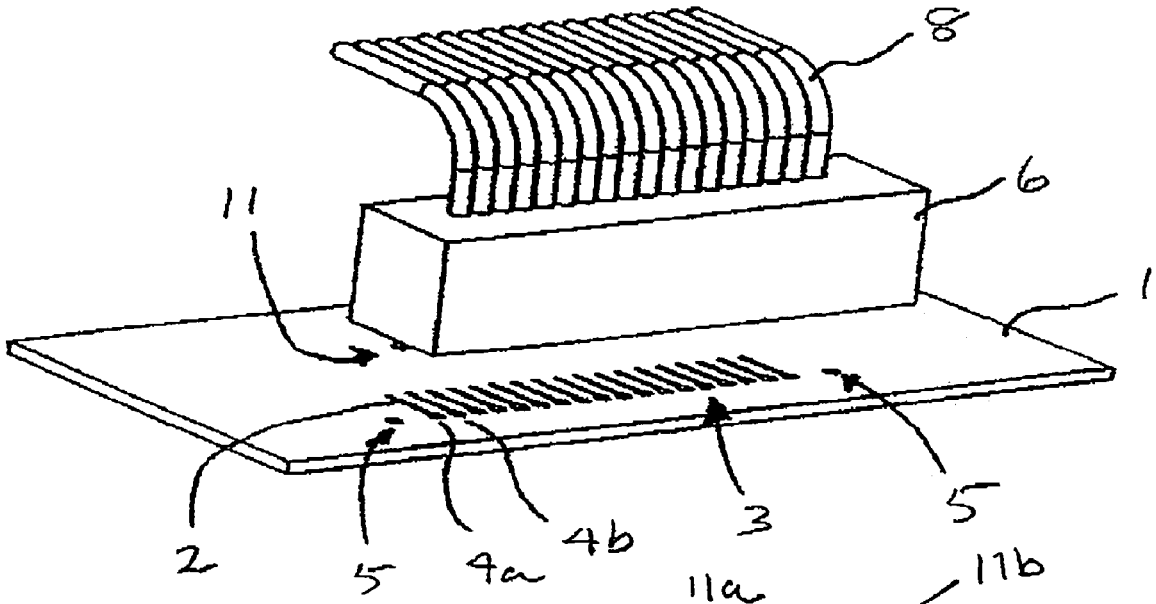

Referring first more particularly to FIGS. 1*a* and 1*b,* a printed circuit board 1 includes a planar face carrying a plurality of spaced parallel strip conductors 2 arranged in a row 3. Soldering contacts 4*a* and 4*b* are provided at one end of the row of strip conductors, and fastening apertures 5 are provided in the printed circuit board at opposite ends of the resultant row.

A plug connector 6 is provided having a strip housing 7 carrying a plurality of conductors 8 that respectively terminate in spaced resilient contacts 9 arranged in a row 10 on a planar face of the plug connector opposite the printed circuit board 1. The row 10 of resilient contacts corresponds with the row 3 of strip conductors 2 and solder pads 4*a,* 4*b,* so that the resilient contacts 9 correspond with the strip conductors 2 and the soldering contacts 4*a,* 4*b,* respectively. A plurality of contact rows 10 may be provided on the connector plug 6 for engagement with corresponding contact rows 3 arranged on the printed circuit board 1.

Figure 1C:
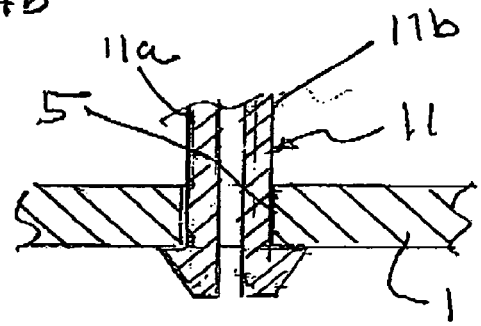
FIG. 1*c* is a detailed sectional view of the snap-fastener means of FIGS. 1*a* and 1*b;*

In accordance with a characterizing feature of the invention, a pair of snap-fastener pins 11 are provided on the plug connector housing 7 opposite the fastening apertures 5. As shown in FIG. 1*c,* the pins are bifurcated and include a pair of resilient fastening arms 11*a* and 11*b* that are biased apart into engagement with the wall of the locking aperture 5 contained in the printed circuit board. As the plug connector 6 is progressively brought toward the printed circuit board, the pins 11 and apertures 5 cooperate both to compress the resilient contacts 9 into engagement with the contact strips 2 and 4 on the printed circuit board, respectively, and to positively fasten the plug connector to the printed circuit board.

The embodiment of FIGS. 1*a*–1*c* is particularly suitable for use by plug connectors of relatively large size. For plug connectors of relatively small size, use is made of auxiliary fastener means, as shown by the second embodiment of FIGS. 2*a*–2*c*.

Figure 2A:
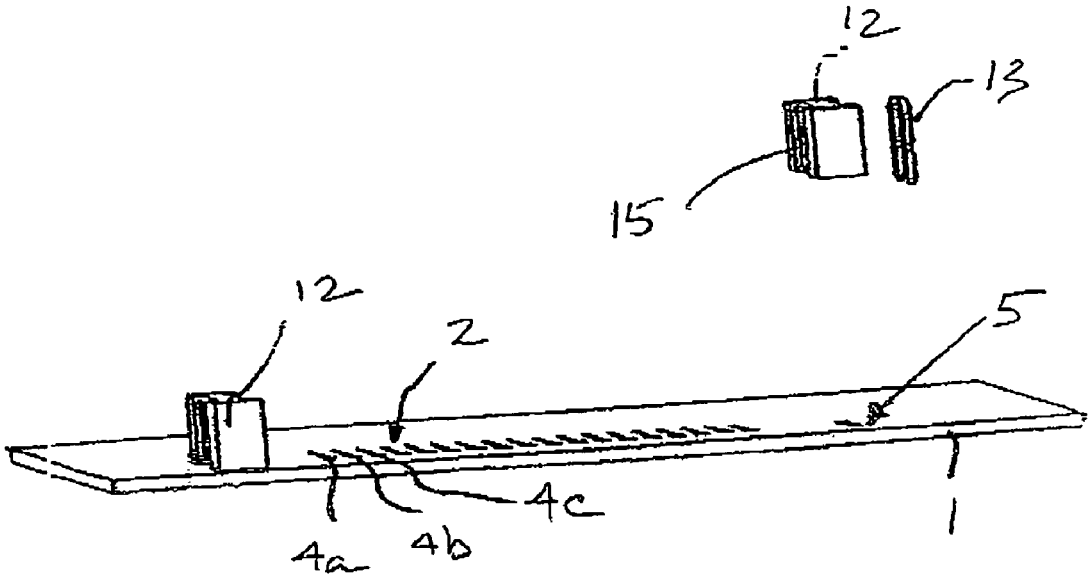
FIG. 2*a* is an exploded perspective view illustrating the first step of assembly of a second embodiment of the invention.
Figure 2B:
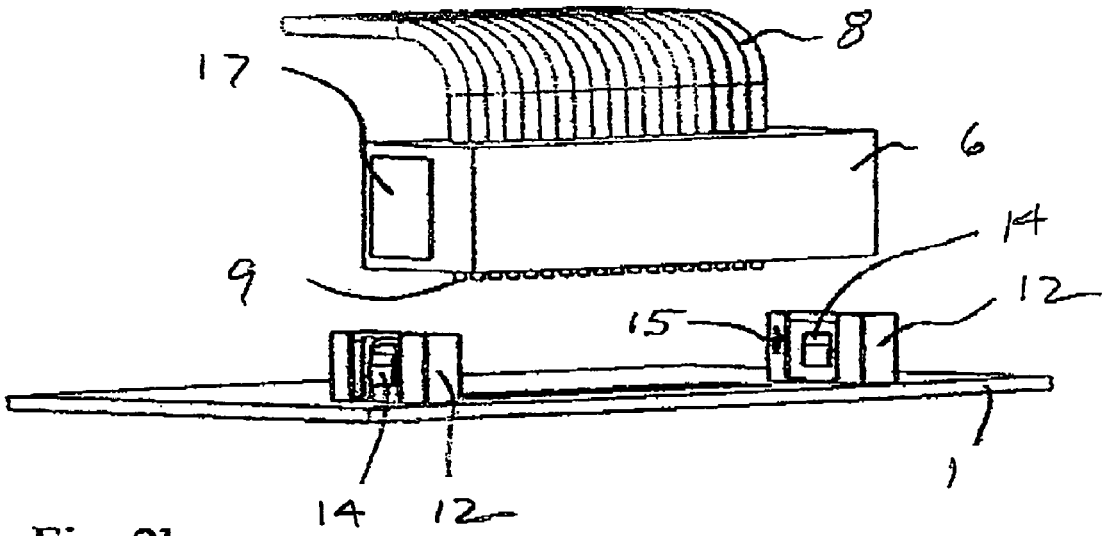
FIG. 2*b* is an exploded view illustrating the second step of assembling the second embodiment of the invention.
Figure 2C:
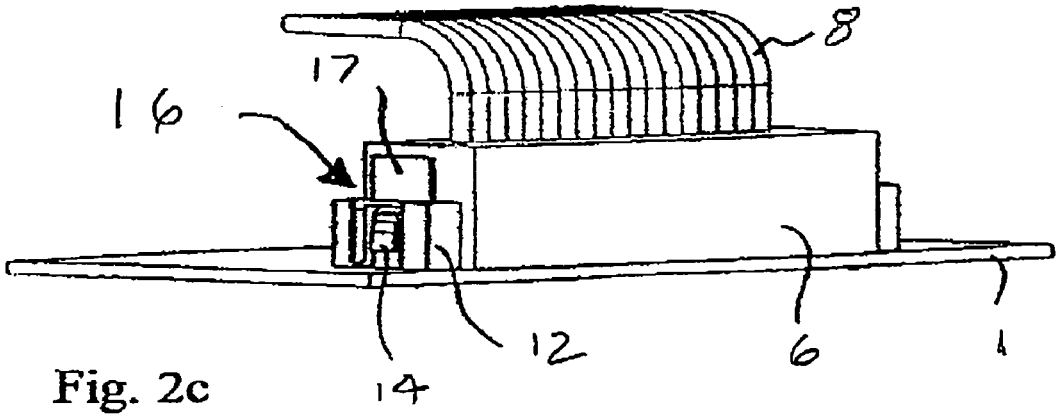
FIG. 2*c* is a perspective view illustrating the assembled second embodiment of the connector plug and printed circuit board assembly.

Referring first to FIG. 2*a,* in this embodiment a pair of attachment lugs 12 are fastened to the printed circuit board 1 at opposite ends of the row 3 of strip conductors by means of conventional soldering clamps 13. The attachment lugs include opposed grooves 15 that receive lateral leaf springs 17 that are mounted on opposite end walls of the plug connector 6. The leaf springs 17 react with lateral fastener members 14 mounted in the attachment lugs 12 to define a snap fastener arrangement that is operable both to fasten the plug connector to the printed circuit board, and to effect compression of the resilient contacts on the plug connector with the contact strips on the printed circuit board.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. Connector means for connecting the contacts of a plug connector with the conductive members of a printed circuit board, comprising:

(a) a printed circuit board (1) having a first planar surface supporting a row (3) of parallel spaced conductive members (2;4*a*,4*b*);

(b) a plug connector (6) including a housing (7) having a bottom wall carrying a row of resilient spring contacts (9*a*, 9*b*) opposite said row of conductive members, respectively, said plug connector including a pair of end walls; and (c) fastening means fastening said plug connector with said printed circuit board to effect electrical contact between said spring contacts and said conductive members, respectively, said fastening means including:

(1) a pair of attachment lugs (12) mounted in spaced relation on said printed circuit board first surface, the adjacent ends of said fastener lugs containing grooves (15), said plug connector being arranged between said attachment lugs with the ends thereof adjacent said attachment lugs, respectively; and (2) snap fastener means (14, 17) for simultaneously fastening the ends of said plug connector to said attachment lugs and for compressing said resilient contacts into engagement with said conductive members, said snap fastener means including:

(a) a pair of lateral fastener members (14) mounted in said grooves, respectively; and (b) a pair of leaf springs (17) mounted on the ends of said plug connector, respectively, said leaf springs being received in said grooves for engagement with said fastener member, respectively.

2. Connector means as defined in claim 1, wherein said row of conductive members includes at one end at least one soldering pad; and further wherein at least one of said attachment lugs is ranged adjacent said soldering pad.

3. Connector means as defined in claim 1, wherein said attachment lugs include coding means for effecting correlation between said plug connector and said printed circuit board.

4. Connector means as defined in claim 1, and further including soldering clamp means (13) for fastening said attachment lugs to said printed circuit board.

5. Connector means as defined in claim 4, wherein said attachment lugs include at least one suction surface for automatic handling of said attachment lugs during the assembly thereof to said printed circuit board.

* * * * *